United States Patent [19]

Hotaling

[11] Patent Number: 4,979,370

[45] Date of Patent: Dec. 25, 1990

[54] PROCESS FOR MANUFACTURING CLEAR AND PATTERN ICE PRODUCTS

[76] Inventor: William E. Hotaling, 86 Woodlawn Ave., Saratoga Springs, N.Y. 12866

[21] Appl. No.: 403,879

[22] Filed: Sep. 7, 1989

[51] Int. Cl.[5] ..... F25C 1/18

[52] U.S. Cl. ..... 62/70; 62/307

[58] Field of Search ..... 62/69, 70, 306–308

[56] References Cited

U.S. PATENT DOCUMENTS

| | | | |
|---|---|---|---|
| 959,697 | 5/1910 | Beals | 62/70 |
| 1,180,533 | 4/1916 | Pownall | 62/70 |
| 1,322,660 | 11/1919 | Voorhees | 62/356 X |
| 1,659,845 | 2/1928 | Voorhees | 62/70 |
| 2,133,521 | 10/1938 | Wussow et al. | 62/70 X |
| 2,506,614 | 5/1950 | Ribeiro | 62/70 |

*Primary Examiner*—William E. Tapolcai

*Attorney, Agent, or Firm*—Schmeiser, Morelle & Watts

[57] ABSTRACT

A process for creating clear ice products where the potable water to be frozen is deoxygenated prior to freezing. A container for the potable clear ice product utilizes a plurality of packets joined together by flexible joints to form an ice pack. Each packet has a tear strip for facilitating the removal of the contents and each packet further has one side made from a mataerial providing for greater heat transfer than the other side of the packet.

7 Claims, 2 Drawing Sheets

PROCESS FOR MANUFACTURING CLEAR AND PATTERN ICE PRODUCTS

FIELD OF THE INVENTION

Generally this invention relates to the production of ice. More specifically, this invention is a process for the production of clear ice, which process may be varied in order to produce substantially predetermined patterns within the ice product. The invention also includes an improved multicellular frangible container for ice product.

BACKGROUND OF THE INVENTION

There are presently available several processes and machines for producing clear ice which is made from potable water. These ice products are desirable for commercial use such as restaurants, bars and the like, since the consumer prefers a clear ice product and is generally accustomed to such a cube. Furthermore, clear ice has less aftertaste then non-clear ice. Other uses for a clear ice product include the field of ice sculpturing. The demand for ice sculptures is quite large, since such items are commonly used at weddings and other celebrations. Furthermore, numerous entertainment establishments use ice sculptures as centers of attraction and to provide a somewhat unique atmosphere. However, providing large blocks of clear ice, which is aesthetically preferable, is very difficult, requiring agitation during freezing of blocks generally weighing three hundred pounds or more.

The primary approach for the production of clear ice products centers around the concept of agitating the water during freezing. This concept is expounded upon in my copending patent application Ser. No. 318,843 filed 03/06/89 the disclosure of which is incorporated by reference into this application. The difficulty sought to be overcome by that application was the lack of any suitable system for forming clear ice in large preformed containers. Other inventions created clear ice by directing air against the top surface of the liquid being frozen, or by circulating the water through tubes during the freezing process, thus creating clear ice cylinders which were directed through a revolving cutter to form cubes. Other methods include spraying ice onto a freezer plate and rotating water containers during freezing.

All of these methods require extremely large freezing containers in which the ice making process can be conducted. This is due to the fact that the water agitation must take place within the freezing compartment. The cost of this process is understandably very high and the shapes of the clear ice being formed are limited by the constraints of the process and the machinery being used. Also, in order to freeze the water during the agitation process, it is necessary to expand a significant amount of energy to provide sufficient refrigeration to freeze the products within a short enough period of time to allow the machine to have sufficient production. Once the ice is formed it is placed in a holding bin, which generally holds over two hundred tons of ice. However, this ice cannot be allowed to congeal, and therefore expensive mixers or driers must be used to keep the ice from forming blocks, which could not be used for consumer bagged ice.

Furthermore, there was no process available for freezing clear ice sculptures in a presculptured form. Such sculptures are understandably very large and therefore not adaptable for freezing by prior clear processes. With my prior application heretofore referenced, one could design a container to reflect the desired end product ice sculpture, but the amount of energy required to freeze such an item during agitation of the water was quite significant. Thus, I decided that it would be extremely advantageous if one could take a contained water product and freeze it in a conventional freezer and still obtain a clear ice product. This would enable the user to obtain an inexpensive clear ice product since one could freeze large quantities of water in commercial freezers which are well insulated and therefore use a minimal amount of energy as compared to the ice making machines presently available.

In addition, ice products for consumer use are sold in bags of four to ten pounds each. These bags contain commercial ice, but suffer the problem that they often congeal, forming ice blocks which must be broken prior to use, a job more easily accomplished with an ice pick rather than the ice cube tongs that are generally available. Of course impacting the bag to break the ice is often effective, however, it often ruptures the bag with resultant leaking as the ice melts.

Another problem with the present ice bag is storage. When packing food for a trip, picnic, camping or the like, it is advantageous to use the newly purchased bag of ice in the food chest. However, these bags of ice are not suitable for packing with food, because they are not adaptable for surrounding a food product, nor are they appropriate for providing a smooth ice pack to be over the food. One can, of course, empty the ice into the cooler, however, this causes the food to become wet, and also contaminates the ice itself, making it less desirable for later consumer use.

SUMMARY OF THE INVENTION

While pursuing the development of additional clear ice processes, I began experimenting with the use of air injectors which would cause air bubbles to travel through the water within the container during freezing. The concept being that the movement of the air bubbles through the water provides the same vibrational effects that were sufficient to create clear ice in other clear ice processes. However, this process still resulted in the need to agitate the product during freezing, a fact which no one seemed to question, as a prerequisite to producing clear ice.

After further consideration of the problem, I considered the use of a different gas since common air tended to contain impurities that altered the taste of the ice. After considering a variety of possible alternatives, initial experimentation began with the use of nitrogen gas, since this gas at normal temperatures and pressures has no taste, color or odor, and is non-toxic and inert. Other uses for nitrogen included its application to other food stuffs such as edible oils and fruit juices to prevent them from becoming rancid. Nitrogen is also applied to margarine and whipped creme in order to whip these otherwise smooth textured food products. Still other uses include the aeration of peanut butter or mayonnaise in order to provide a fluffy texture and wine in order to stop oxidation and thereby control the fermentation process. Thus, since it was clear that nitrogen was suitable for use with foods due to its non-toxic nature and the fact that it had no odor or taste, I was led to its use in the ice making process.

During my initial testing, I bubbled nitrogen through the container while attempting to freeze the container simultaneously. Serendipitously, I then bubbled nitrogen through the water in the container and instead of simultaneously freezing the container, I simply sealed it and placed it into a freezer. Upon retrieving the frozen product, I found that even though the freezing was not applied during the bubbling step the ice was substantially clear. Further experimentation found that the degree of clarity of the ice and the pattern of the cloudiness within the ice could all be varied by the duration of the bubbling process and the location of the nitrogen inlets. Also affecting the cloudiness was the temperature of the freezer and the concomitant length of time during which the freezing took place.

From further tests I discovered that venting the accumulated gases above the liquid aided in the total clarity of the ice being produced. This can be accomplished either by natural venting or by use of a vacuum to withdraw the gases as they arise out of the water.

With these discoveries, it was now possible for containers of water to be treated with nitrogen bubbling and then be stacked into conventional freezers where the freezing Process could be done with only a low energy output, yet still produce a clear ice product. Also, since the freezing takes place after the treatment of the water in the containers, various container designs of virtually any desired size and shape could be manufactured for the production of clear ice sculptures.

DETAILED DESCRIPTION OF THE PREFERRED EMBODIMENT

Figure 1:
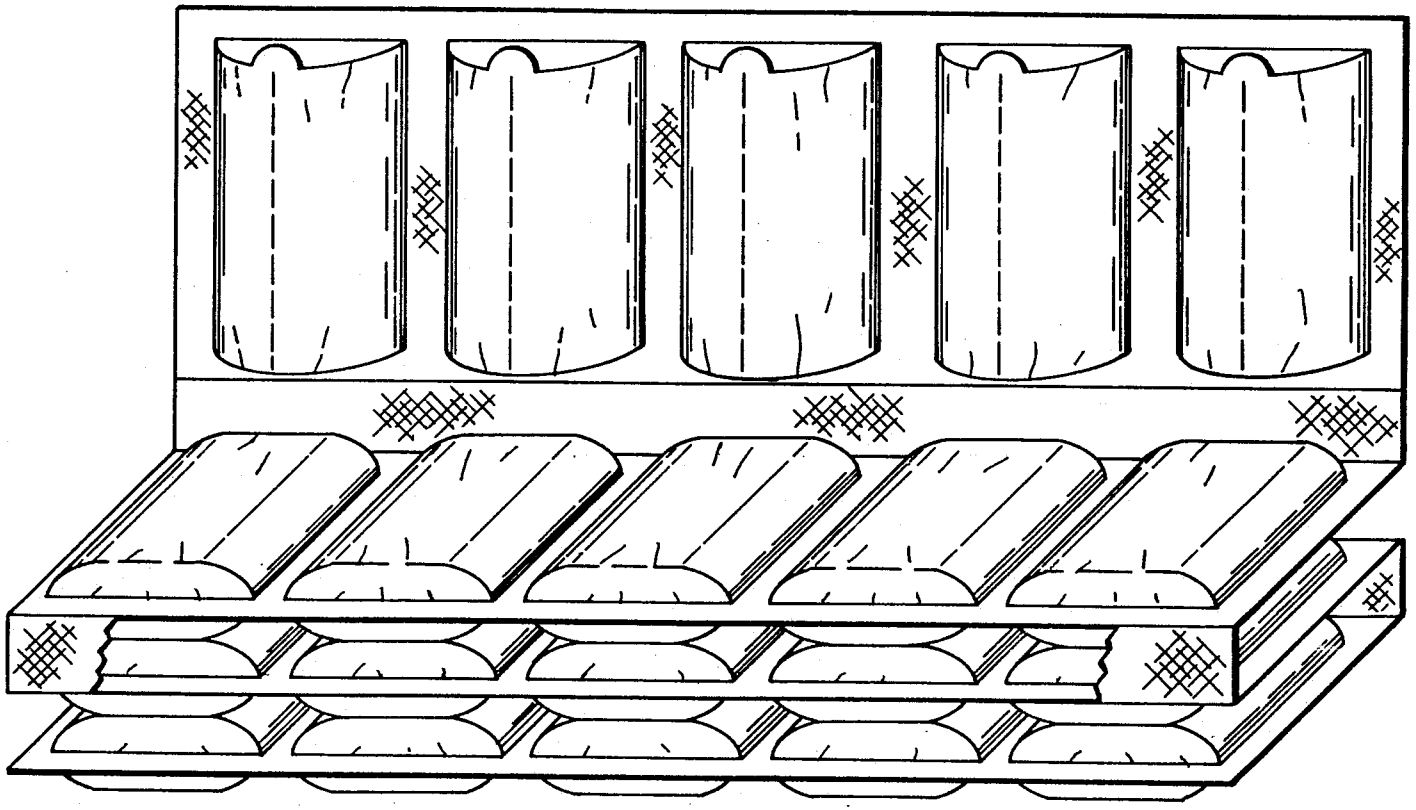
FIG. 1 is an elevational view of the container of this invention with a partial breakaway.
Figure 2:
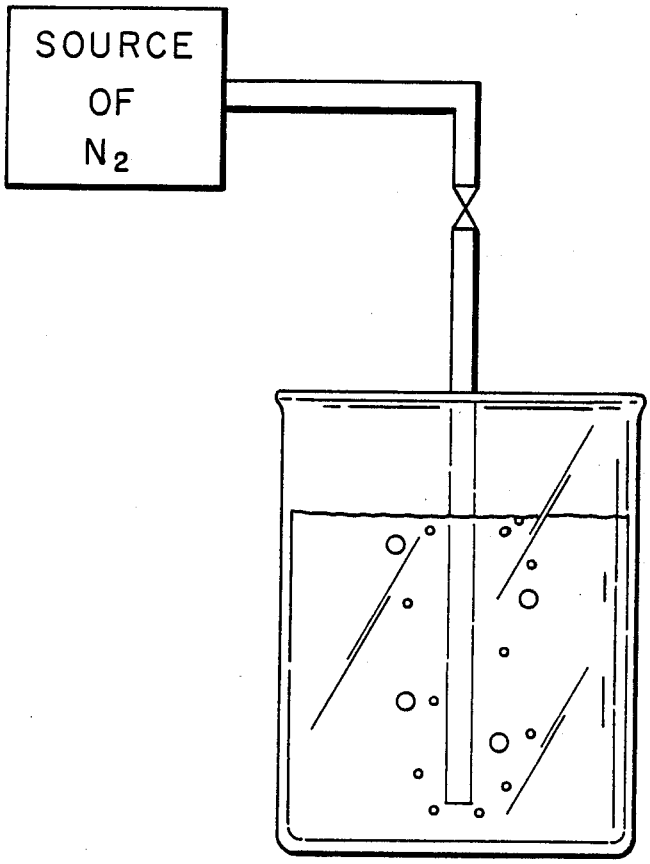
FIG. 2 is a schematical view of a system for bubbling an inert gas through a contained volume of water.

The process of this invention relates to the partial removal of oxygen from water prior to freezing the water to create an ice product.

In the preferred embodiment a quantity of potable water is deposited within the container. The container may be of virtually any predetermined size dependant upon the apparatus in use. Depending on the size of the container, one must determine the number of inlets and their positioning toward the bottom of the container. Once the water is contained, the top of the container can either be left open or if the opening at the top is not of sufficient size a vacuum source may be applied to the opening in order to draw off the gasses which will exit through the top surface of the water.

A predetermined supply of gas, preferably nitrogen, is secured to tubing which will allow the nitrogen to be pumped through the tubing into the bottom of the container so that the nitrogen bubbles through the water. While nitrogen is utilized in the preferred embodiment it should be appreciated that other non-toxic and preferably inert gasses may be used. Nitrogen was selected for its common usage with food products as it is not only non-toxic but has no taste, color or odor at the temperatures relevant to the processes involved in this invention. Furthermore, the bubbling of the nitrogen through the water is primarily for the purpose of removing oxygen which tends to cause cloudiness and may also contain impurities which affect the taste of the ice cube. Thus, it should be appreciated that other methods of removing oxygen may also be suitable for these purposes.

After the desired amount of oxygen is removed the deoxygenated water may be transferred to whatever container is desirable. For example, one may use the water to fill the small ice packets included in the subject invention or may fill various design containers which will serve as ice sculptures. After filling the desired container the container and the now treated water are placed in a freezer for solidification. It will be found that after freezing the ice product is substantially clear or has a substantially predetermined cloudiness pattern based upon variations of the process.

For example, utilizing "Type I" nitrogen as defined by the Compressed Gas Association one may bubble the nitrogen through a container with two pounds of water utilizing only one nitrogen inlet centered in the base of the container. The length of time during which the nitrogen is being bubbled through the water and the flow rate of the nitrogen may be varied to obtain a variety of results. However, for a two pound block one may bubble the nitrogen through the water at a relatively slow rate for fifteen seconds. Thereafter, the container is closed at both the top and at the nitrogen inlet and placed in a freezer at twenty degrees Fahrenheit. For ice products below two pound blocks the twenty degree centigrade temperature provides less cloudiness than when freezing it at lower temperatures such as zero degrees centigrade. However, where the blocks of ice are in excess of two pounds freezing at zero degrees centrigrade does not substantially reduce the clarity of the ice product.

It is also possible to use a plurality of small nitrogen inlets. For example, given a one foot square container base one may utilize nine nitrogen inlets, each inlet having a diameter of approximately 0.25 inches spaced evenly in three rows of three. In this situation, introduction of nitrogen for one minute or so will after freezing result in the creation of a cloud pattern, and if the ice block is allowed to increase in temperature to the extent that it melts slightly the cloud dissapates and strands or threads that are actually tunnel appear in the ice. Shorter nitrogen bubbling will create a clear ice product.

For the purpose of this disclosure, the term deoxygenating refers to the reduction in oxygen within the potable water. It should be noted that the degree of reduction may vary significantly within the scope of the invention with the resultant effect being variations in the clarity of the ice product. Thus, for the purposes of this invention, deoxygenation means the reduction of at least 20% of the oxygen content of the water being treated.

The container of this invention is disclosed in FIG. 1 wherein the ice pack 10 has a plurality of individual or unitary sealed packets 12 joined to adjacent packets by means of flexible joints 14. This allows the pack to be folded along any of the joint lines as shown at 16. The method for accomplishing this is well known in the industry through the use of machinery such as circular vertical form/fill/seal machines commonly used to fill individual packets with shampoos, bath oils and the like. However, in the subject invention the packets are formed in a ice pack or mat 10 with the contents being potable deoxygenated water. Furthermore, it is expected that one side 18 of the packets 12 may be made of a plastic material while the other side 20 may be made of a material such as aluminum which has a greater ability to conduct temperature variations. Thus, one may take the pack 10 and lay it flat over the top of food in a cooler with the aluminum side down thereby guaranteeing a more complete cooling of the food products under the pack with a slowed melting due to the less conductive surface on side 18. It should be appreciated that due to the manner in which the pack may be articulated food products may be wrapped within the pack 10 for quicker cooling.

Each packet has a tear strip 22 for rupturing the packet 12 and removing the ice product therein. An important aspect of the tear strip 22 is that it travels the entire length of either a side of the packet or an end 24 to facilitate complete removal of the ice product.

Thus, this invention allows the ice pack to be used to cool food products and then allows for the removal of all individual ice cubes for use in drinks and the like. It should be appreciated that the tear strip may be fashioned in any one of a number of ways so long as an entire side or end is ruptured. In my preferred embodiment I find it easiest to simply place a tear string within the packet connected at the tab 26 of the tear strips 22 and also secured at its other end 28.

The size of each packet is important as this is necessary to support the intended use of the item. Thus, the length of the packet from end to end is no more than three (3.0) inches and the width of a side is no more than one and one quarter (1.25) inches. Furthermore, the thickness of the packet from the midpoint of one side to the midpoint of the other wide it is no more than one (1.0) inch. The packets are also positioned to stack when folded as shown in the figure. This creates channels 30 between the packs to facilitate quicker freezing.

For easy use perforations 32 between the packets allows each packet to be separated from the pack for easy distribution. While the above describes the preferred embodiment of the subject invention it should be appreciated that numerous changes may be made within the scope of the invention without the parting from the spirit thereof and therefore the invention shall only be limited by the appended claims.

What is claimed is:

1. A method for producing ice comprising:

enclosing a predetermined quantity of water in a container, said container having bottom and top portions;

providing a venting area above the water;

beginning a deoxygenation process by pumping a substantially pure, nontoxic, inert gas into the bottom portion of the container;

bubbling said gas through the water for a predetermined period of time to thereby cause said predetermined quantity of water to become deoxygenated;

discontinuing the flow of gas into the water thereby terminating the deoxygenation process; and freezing said water.

2. The invention of claim 1 further comprising the step of: venting said container top portion for dispensing gas accumulated in said container above the water as a result of said bubbling step.

3. The invention of claim 2 wherein said venting includes the step of withdrawing excess gas from the container.

4. The invention of claim 1 wherein said inert gas is nitrogen.

5. A method for producing clear ice comprising:

enclosing a predetermined quantity of water in a container, said container having bottom and top portions;

providing a venting area above the water;

deoxygenating the water by bubbling pure nitrogen gas through the water;

discontinuing the deoxygenation process by discontinuing the bubbling of nitrogen gas through the water; and freezing said water.

6. A method for producing ice comprising:

enclosing a predetermined quantity of water in a treatment container, said container having bottom and top portions;

providing a venting area above the water;

pumping a gas into the bottom portion of the container, said gas being nontoxic, inert and comprised substantially of only a single element;

bubbling said gas through the water for a predetermined period of time to thereby cause said predetermined quantity of water to become deoxygenated;

removing at least a portion of the deoxygenated water from the treatment container and placing it in at least one other container; and placing said at least one other container in an environment which causes the contained deoxygenated water to freeze and produce substantially clear ice.

7. The invention of claim 6 further comprising the step of: venting a top portion of said treatment container for dispensing gas accumulated in said container above the water as a result of said bubbling step.

* * * * *